US010854408B2

(12) United States Patent
Gutmann et al.

(10) Patent No.: US 10,854,408 B2
(45) Date of Patent: Dec. 1, 2020

(54) MAGNETIC FLUX ASSEMBLY FOR A RELAY, AND RELAY

(71) Applicant: Tyco Electronics Austria GmbH, Vienna (AT)

(72) Inventors: Markus Gutmann, Brand (AT); Rudolf Mikl, Maria Ellend (AT); Paul Indrajit, Markdorf (DE)

(73) Assignee: Tyco Electronics Austria GmbH, Vienna (AT)

( * ) Notice: Subject to any disclaimer, the term of this patent is extended or adjusted under 35 U.S.C. 154(b) by 142 days.

(21) Appl. No.: 15/661,136

(22) Filed: Jul. 27, 2017

(65) Prior Publication Data

US 2017/0323749 A1 Nov. 9, 2017

Related U.S. Application Data

(63) Continuation of application No. PCT/EP2016/052003, filed on Jan. 29, 2016.

(30) Foreign Application Priority Data

Jan. 30, 2015 (EP) ..... 15153203

(51) Int. Cl.

| | |
|---|---|
| ***H01H 50/36*** | (2006.01) |
| ***H01H 50/24*** | (2006.01) |
| ***H01H 50/42*** | (2006.01) |
| ***H01H 50/40*** | (2006.01) |
| *H01H 50/26* | (2006.01) |

(52) U.S. Cl.

CPC ..... *H01H 50/24* (2013.01); *H01H 50/40* (2013.01); *H01H 50/42* (2013.01); *H01H 50/26* (2013.01); *H01H 50/36* (2013.01)

(58) Field of Classification Search

CPC ..... H01H 50/24; H01H 50/26; H01H 50/36; H01H 50/40; H01H 50/42

See application file for complete search history.

(56) References Cited

U.S. PATENT DOCUMENTS

| | | | | |
|---|---|---|---|---|
| 4,514,711 | A | 4/1985 | Nagamoto et al. | |
| 5,894,254 | A | 4/1999 | Reiter et al. | |
| 6,545,575 | B1 * | 4/2003 | Hirabayashi ..... | H01H 50/042 335/128 |
| 6,674,353 | B1 | 1/2004 | Hanke et al. | |

FOREIGN PATENT DOCUMENTS

| | | | |
|---|---|---|---|
| CN | 1369893 | A | 9/2002 |
| CN | 2638225 | Y | 9/2004 |
| CN | 103000451 | A | 3/2013 |

(Continued)

OTHER PUBLICATIONS

European Office Action, European Patent Application No. 15 153 203.3, dated Oct. 4, 2018, 4 pages.

Chinese Second Office Action with English translation, Chinese Patent Application No. 201680007409.3, dated Feb. 3, 2019, 16 pages.

European Search Report, dated Aug. 7, 2015, 6 pages.

(Continued)

*Primary Examiner* — Ramon M Barrera

(74) *Attorney, Agent, or Firm* — Barley Snyder

(57) ABSTRACT

A magnetic flux assembly for closing a magnetic circuit of a relay and a relay. The magnetic flux assembly has a yoke and a U-shaped armature that is movable relative to the yoke. The yoke has a coil part that is in a coil and a flux conduction part that conducts the magnetic flux generated by the coil.

18 Claims, 2 Drawing Sheets

(56) References Cited

FOREIGN PATENT DOCUMENTS

| | | | | |
|---|---|---|---|---|
| EP | 1154452 | A1 | | 11/2001 |
| JP | S5156950 | A | | 5/1976 |
| JP | S55-124268 | A | | 9/1980 |
| JP | S62-291006 | A | | 12/1987 |
| JP | H01-137174 | A | | 5/1989 |
| JP | H01-189904 | A | | 7/1989 |
| JP | 1989-298709 | | * | 12/1989 |
| JP | H04-102140 | U | | 9/1992 |
| JP | H08-235996 | A | | 9/1996 |
| JP | H10-321110 | A | | 12/1998 |
| JP | 2002-541621 | A | | 12/2002 |
| WO | 0011695 | A1 | | 3/2000 |

OTHER PUBLICATIONS

Japanese Notice of Reasons for Refusal and English translation, dated May 22, 2018, 14 pages.
Abstract of JPH08-235996A, dated Sep. 13, 1996, 1 page.
Abstract of CN103000451A, dated Mar. 27, 2013, 1 page.
Chinese First Office Action, English translation, dated Jun. 4, 2018, 9 pages.
Abstract of JPH01-137174A, dated May 30, 1989, 1 page.
Abstract of JPS62-291006A, dated Dec. 17, 1987, 1 page.
Abstract of JPS55-124268A, dated Sep. 25, 1980, 1 page.
Abstract of JPH01-189904A, dated Jul. 31, 1989, 1 page.
European Search Report, dated Jul. 12, 2017, 4 pages.
Chinese Third Office Action with English translation, Chinese Patent Application No. 201680007409.3, dated Jul. 15, 2019, 16 pages.
Abstract of CN1369893 A, dated Sep. 18, 2002, 1 page.
Abstract of CN2638225 Y, dated Sep. 1, 2004, 1 page.

* cited by examiner

MAGNETIC FLUX ASSEMBLY FOR A RELAY, AND RELAY

CROSS-REFERENCE TO RELATED APPLICATIONS

This application is a continuation of PCT International Application No. PCT/EP2016/052003 filed on Jan. 29, 2016, which claims priority under 35 U.S.C. § 119 to EP 15153203.3, filed Jan. 30, 2015.

FIELD OF THE INVENTION

The invention relates to a magnetic flux assembly for closing a magnetic circuit of a relay and a relay.

BACKGROUND

Relays usually comprise a coil that is attached to a control circuit. When the coil is energized, it creates a magnetic flux which is then guided by a yoke. The magnetic flux then creates a magnetic force that attracts an armature and tries to pull the armature towards the yoke and to close the magnetic circuit. A problem associated with known relays is that high magnetic forces, and thus a high current in the control circuit or a high number of windings in the coil, are necessary for switching, in particular, if a load circuit connected to the armature is closed in the open position of the magnetic flux assembly.

SUMMARY

According to a first aspect of the present invention, a magnetic flux assembly for closing a magnetic circuit of a relay includes a yoke and a U-shaped armature movable relative to the yoke. The yoke has a coil part in a coil and a flux conduction part that conducts magnetic flux generated by the coil.

According to a second aspect of the present invention, a relay includes a coil and a magnetic flux assembly that has a yoke and a U-shaped armature movable relative to the yoke. The yoke has a coil part in the coil and a flux conduction part that conducts magnetic flux generated by the coil.

DETAILED DESCRIPTION OF THE EMBODIMENT(S)

Figure 1:
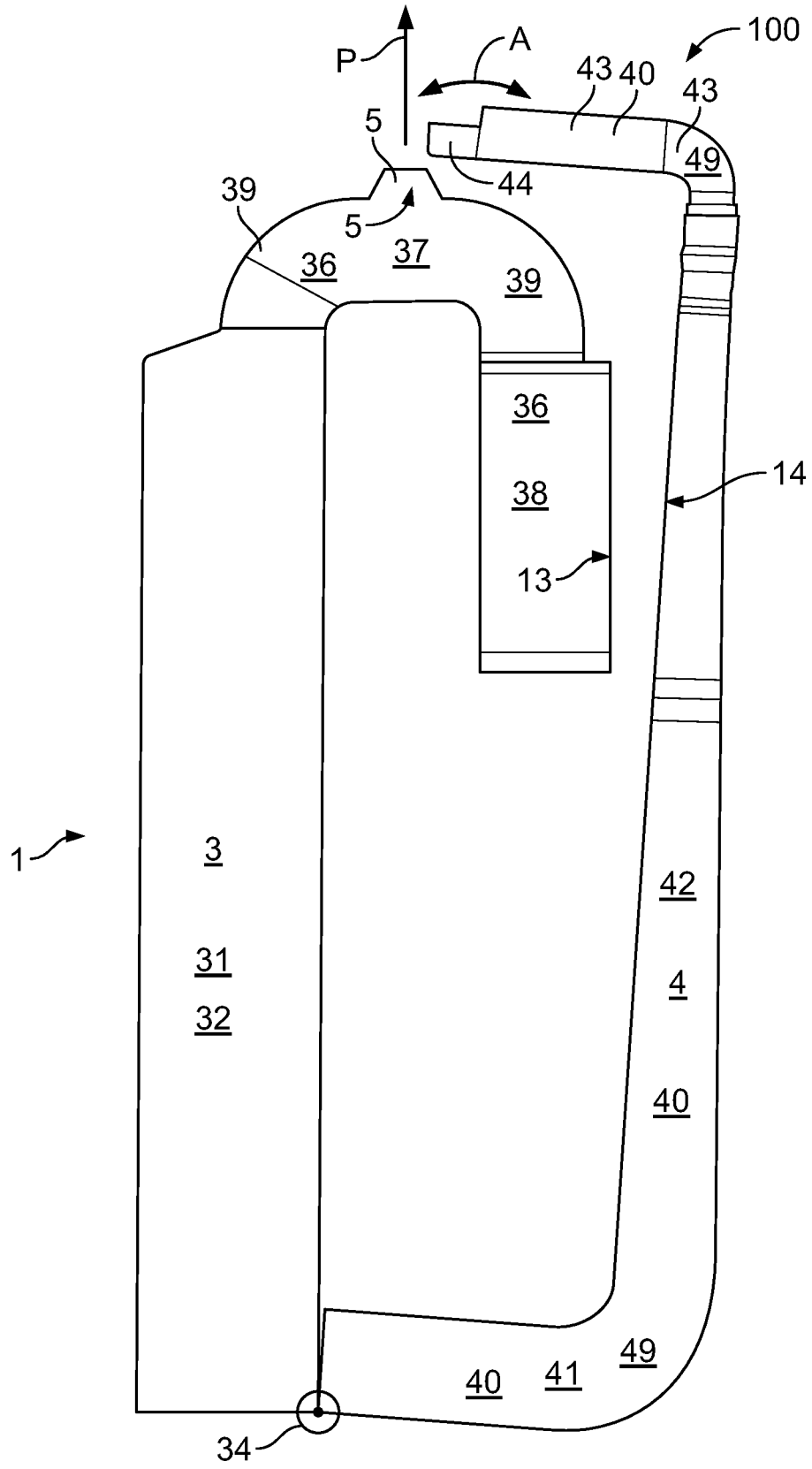
FIG. 1 is a side view of a magnetic flux assembly constructed in accordance with the present invention.
Figure 2:
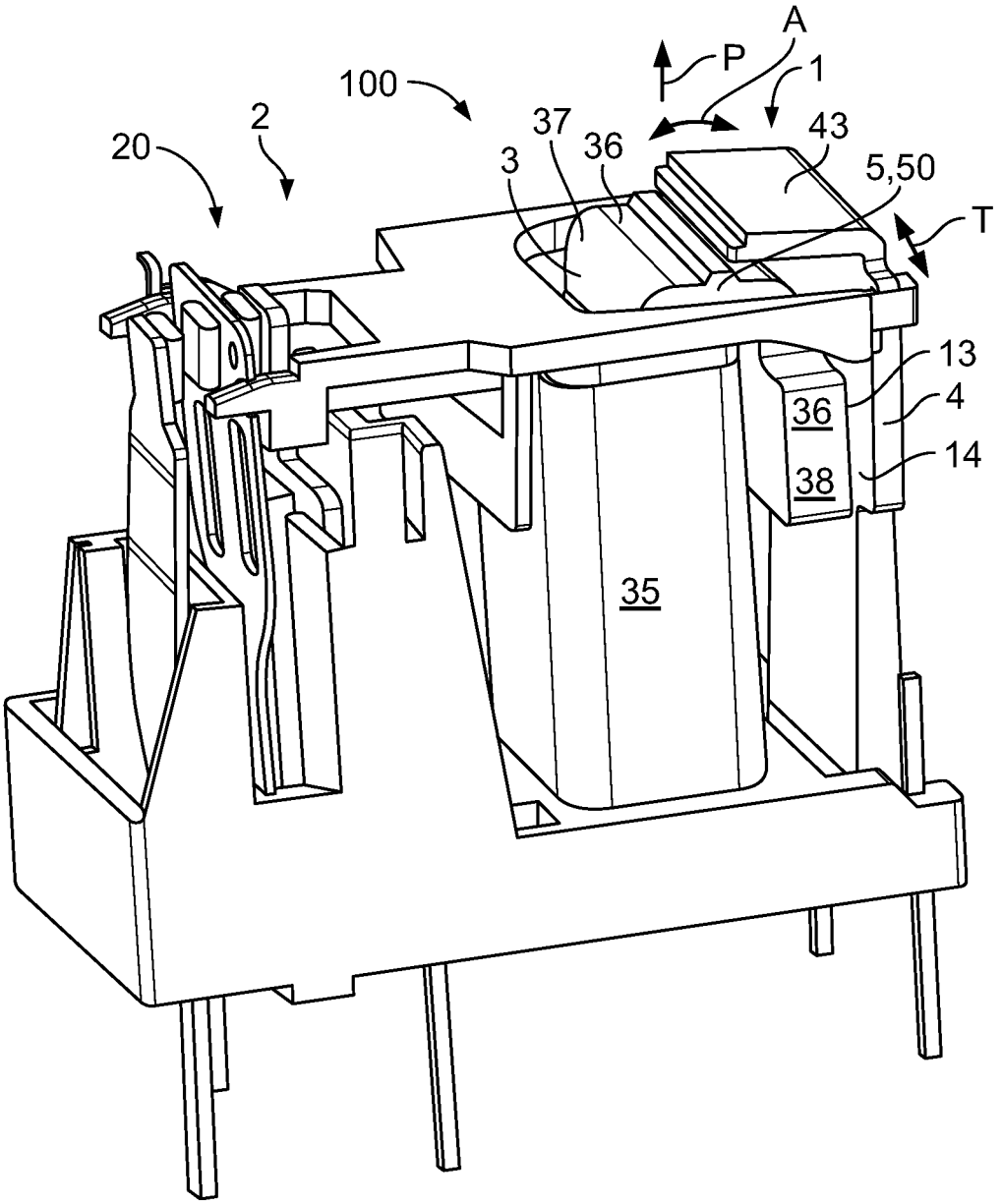
FIG. 2 is a perspective view of the FIG. 1 magnetic flux assembly together with other parts of a relay.

In FIGS. 1 and 2, a magnetic flux assembly 1 for closing a magnetic circuit of an electromagnetic switching device 2 in the form of a relay 20 is depicted. A side view is shown in FIG. 1. A perspective view of the magnetic flux assembly 1 together with other parts of the relay 20 is shown in FIG. 2.

The magnetic flux assembly 1 comprises a yoke 3 and an armature 4 that is movable relative to the yoke 3. The armature 4 can move relative to the yoke 3 by tilting or pivoting the armature in an actuation direction A about a hinge axis 34 where the armature 4 is coupled to the yoke 3.

The yoke 3 comprises a coil part 31 in the form of a leg 32 that is received in a coil 35. The yoke 3 further comprises a flux conduction part 36 in the form of a central leg 37 and a further leg 38. When the coil 35 is energized, that means when a current is running through the control circuit, magnetic flux is generated in the coil 35. The coil part 31 receives this magnetic flux and conducts it to the flux conduction part 36. The yoke 3 creates a magnetic force that tries to pull the armature 4 towards the yoke and close the magnetic circuit.

The yoke 3 and the armature 4 each have a magnetic attraction faces 13 and 14, respectively, which provide a large area so that a high magnetic force can be achieved. The magnetic attraction faces 13, 14 face towards the other element and lie opposite to each other in the open state 100 depicted in FIGS. 1 and 2. In a closed state, the two magnetic attraction faces 13, 14 rest on each other and act as a limit stop for the movement of the armature 4 relative to the yoke 3. The magnetic attraction faces 13, 14 can correspond to each other in size and geometry to achieve a good effect.

The magnetic attraction face 13 on the yoke 3 can be located at a free end so that maximum concentration of the magnetic flux in the magnetic attraction face is possible. As a result, the effect is enhanced and the current necessary for switching can be reduced.

The magnetic attraction face 14 of the armature 4 can be located at the base or the central leg 42. A force distribution can be better than when the magnetic attraction base is located at an end.

The magnetic attraction faces 13, 14 serve to provide big surface areas so that an attractive magnetic force is higher. The magnetic attraction faces 13, 14 can be perpendicular to a direction A of relative movement between the yoke 3 and the armature 4 to achieve the best possible results. The magnetic attraction faces 13, 14 serve as a stop for the armature in the closed state. As a result, the magnetic attraction faces 13, 14 each have a double function which minimizes the number of parts and the space requirements.

The armature 4 is U-shaped. It has three legs 41, 42, and 43 that are connected to each other via the bends 49. A proximal leg 41 is hinged to the coil part 31 of the yoke 3 and is perpendicular to the coil part 31.

A central leg 42 is between the proximal leg 41 and a distal leg 43. The central leg 42 is at 90° angles to the proximal leg 41 and the distal leg 43. The central leg 42 comprises, in particular, the magnetic attraction face 14 that is wider than faces immediately adjacent to it.

In another advantageous embodiment, in the open position the distance between a distal leg 43 of the armature 4 and the yoke 3 is smaller than a distance between a central leg 42 of the armature 4 and the yoke 3. The distal leg 43 can be a leg that is further away from a hinge point 34 than the other legs. By this configuration, a maximum lever length can be achieved.

In the open position 100, the two magnetic attraction faces 13 and 14 are spaced apart considerably from each other. Thus, a high magnetic flux and a high current in the coil 35 would be necessary to switch the magnetic flux assembly 1 to the closed position, if only this mechanism would be present. However, in order to make the switching easier, the armature 4 is U-shaped and has, in particular, the distal leg 43. This distal leg 43 overlaps the yoke 3 at least in sections. In particular, it overlaps the central leg 37 of the yoke 3 in the open position. In this open position 100, the distance between the distal leg 43 and the central leg 37 of the yoke 3 is smaller than the distance between the two magnetic attraction faces 13, 14. Thus, a lower current is necessary to initiate the movement of the armature 4 from the open position 100. This is particularly important when, in the open position 100 of the magnetic flux assembly, a load circuit is closed and/or biased, for example by a spring.

A magnetic attraction face of the yoke 3 can be opposite a magnetic attraction face of the armature 4 in an open position to achieve the maximum effect. In particular, the two magnetic attraction faces can rest against each other in a closed state. The faces can correspond to each other in size and in geometry to achieve a good effect.

The magnetic attraction face 13 of the yoke 3 can be located at a free end so that a maximum concentration of the magnetic flux in the face is possible. As a result, the effect is enhanced and the current necessary for switching can be reduced.

The magnetic attraction face 14 of the armature 4 can be located at the base or a central leg 42. A force distribution can be better than when the magnetic attraction face is located at an end.

In this embodiment, the yoke 3 is basically U-shaped with three legs 32, 37, and 38. In a simpler configuration, the yoke 3 could be L-shaped. In particular, the second outer leg 38 could be removed. In this case, the armature 4 could, for example, be limited in its movement by the central leg 37 of the yoke 3.

In yoke 3, one leg can be shorter than the other leg. In particular, the leg 38, outside the coil 35, can be shorter than the leg 32 arranged inside the coil in order to save space. In an alternative embodiment, two outer legs 32 and 38 can be connected by a central leg 37 or part that is at least section-wise straight, to allow a design in which one of the outer legs can be spaced further away from the other outer leg. The two outer legs 32 and 38 can, in particular, be parallel to each other.

In order to improve the effect of the overlapping distal leg 43, a protrusion 5 is located on the central leg 37. The protrusion 5 protrudes in a protrusion direction P that is basically perpendicular to the actuation direction A. The protrusion 5 protrudes towards the distal leg 43, directing the magnetic flux onto the distal leg 43. The protrusion 5 does not limit the movement of the armature 4 in the actuation direction. Rather, the armature 4 can pass the protrusion during this movement.

In order to concentrate the magnetic flux in the distal leg 43, the distal leg has a tip 44, the width of which in the protrusion direction P is smaller than the rest of the distal leg 43.

The protrusion 5, shown in FIGS. 1 and 2, has a trapezoidal cross-section. This trapezoidal cross-section is easy to produce by embossing or stamping. In order to concentrate the magnetic flux further, the protrusion 5 could have a different cross-section, for example a triangular or a rectangular cross-section with smaller angles can lead to a better effect as the magnetic flux can be more concentrated in such sharp corners. For example, a rectangular cross-section could be possible. Further, the protrusion 5 could at least in sections have a round cross-section, for example a semi-circular cross-section.

The protrusion 5 can, in particular, be arranged on an outer face of the armature 4 so that a high flux density can be achieved. In the case of a U-shaped yoke 3, the protrusion 5 can be located on a central part in order to enable a compact design.

The fact that the distal leg 43 of the armature 4 is the part that overlaps the yoke 3 in the open position 100, guarantees that the length of the lever relative to the hinge axis 34 is long. Thus, even a small force between the protrusion 5 and the distal leg 43 can ensure that the magnetic flux assembly is being closed.

The protrusion 5 is an elongated rib 50. The elongated rib 50 extends along a transverse direction T that is perpendicular to the actuation direction A and the protrusion direction P. The elongated configuration of the protrusion 5 results in a long interaction area for interaction between the protrusion 5 and the distal leg 43. By this, the effect can be enhanced and the magnetic flux necessary for switching can be lower. Further, an elongated rib can be produced easily.

The relay 20 can have an open position and a closed position. In the open position, the armature 4 is closer to the yoke 3 than in the closed position. In the open position, the armature 4 overlaps the yoke 3 at least in sections. This helps to generate the initial force for closing the magnetic flux assembly. In particular, the yoke 3 and/or the armature 4 can comprise overlapping elements that are designed to overlap the other one of the two. These overlapping elements can give a defined overlap.

What is claimed is:

1. A magnetic flux assembly for closing a magnetic circuit of a relay comprising:

a U-shaped yoke having:

(a) a first leg defining a coil part in a coil, (b) a flux conduction part that conducts magnetic flux generated by the coil and including a second leg and a central leg extending between the first leg and the second leg, and (c) a protrusion extending from the central leg; and a U-shaped armature movable relative to the yoke, the protrusion protruding in a direction of the armature for conducting magnetic flux towards the armature.

2. A magnetic flux assembly according to claim 1, wherein the armature is hinged to the yoke.

3. A magnetic flux assembly according to claim 2, wherein the second leg is parallel to the first leg.

4. A magnetic flux assembly according to claim 1, wherein the protrusion is an elongated rib extending transverse to movement of the armature relative to the yoke.

5. A magnetic flux assembly according to claim 4, wherein the protrusion has a trapezoidal cross-section.

6. A magnetic flux assembly according to claim 5, wherein the protrusion is embossed.

7. A magnetic flux assembly according to claim 1, wherein:

(a) the armature has a magnetic attraction face, and (b) the yoke has a magnetic attraction face independent from the protrusion and facing the magnetic attraction face of the armature that is wider than faces immediately adjacent to the magnetic attraction face of the yoke.

8. A relay comprising:

a coil; and a magnetic flux assembly comprising:

(a) a yoke having:

(1) a coil part in the coil, (2) a flux conduction part that conducts magnetic flux generated by the coil, and (3) a protrusion; and (b) a U-shaped armature having:

(1) a proximal leg pivotally connected to the yoke, (2) a central leg defining a magnetic attraction face, and (3) a distal leg, wherein the protrusion protrudes toward the distal leg, wherein the armature is movable relative to the yoke, in the open position a distance between the distal leg of the armature and the yoke is smaller than a distance between the central leg of the armature and the yoke, the protrusion protruding in a direction of the armature for conducting magnetic flux towards the armature.

9. A relay according to claim 8, further including an electromagnetic switching device that has an open position and a closed position, and wherein:

(a) in the closed position, the armature is closer to the yoke than in the open position, and (b) in the open position, the armature at least partially overlaps the yoke.

10. A relay according to claim 8, wherein the proximal leg of the armature is hinged to the yoke.

11. A relay according to claim 10, wherein the yoke is U-shaped.

12. A relay according to claim 8, wherein the protrusion has a trapezoidal cross-section.

13. A relay according to claim 12, wherein the protrusion is embossed.

14. A relay according to claim 8, wherein the yoke has a magnetic attraction face facing the armature that is wider than faces immediately adjacent to it.

15. A magnetic flux assembly for closing a magnetic circuit of a relay comprising:

a yoke having a coil part in a coil and a flux conduction part that conducts magnetic flux generated by the coil; and a U-shaped armature including a proximal leg, a central leg, and a distal leg, the armature movable relative to the yoke between an open position and a closed position in an actuation direction, a first magnetic attraction face defined on the central leg of the armature is closer to a second magnetic attraction face of the yoke in the closed position than in the open position, the armature overlaps the yoke in a direction perpendicular to the actuation direction in the open position, the coil part of the yoke arranged generally parallel to the flux conduction part having the second magnetic attraction face.

16. A magnetic flux assembly according to claim 15, wherein a distance between the distal leg and the yoke is smaller than a distance between the central leg and the yoke in the open position.

17. A magnetic flux assembly according to claim 15, wherein the yoke is U-shaped and the armature is hinged to the coil part of the yoke.

18. A magnetic flux assembly according to claim 15, wherein the yoke has a protrusion extending in a direction towards the distal leg of the armature.

* * * * *